United States Patent [19]

Michalak et al.

[11] Patent Number: 4,732,210

[45] **Date of Patent: * Mar. 22, 1988**

[54] COLUMN-TYPE REGENERATIVE GAS-GAS HEAT EXCHANGER WITH HEAT-TRANSFERRING ELEMENTS

[75] Inventors: Stanislaw Michalak, Ratingen; Bernd Hermanns, Gummersbach-Rebbelroth, both of Fed. Rep. of Germany

[73] Assignee: L. & C. Steinmüller GmbH, Gummersbach, Fed. Rep. of Germany

[ * ] Notice: The portion of the term of this patent subsequent to Nov. 30, 1999 has been disclaimed.

[21] Appl. No.: 882,543

[22] Filed: Jul. 7, 1986

Related U.S. Application Data

[62] Division of Ser. No. 421,485, Sep. 22, 1982, Pat. No. 4,598,766.

[30] Foreign Application Priority Data

Apr. 22, 1982 [DE] Fed. Rep. of Germany ..... 3214958

[51] Int. Cl.[4] ..... F28D 19/02; F28C 3/16; B01D 51/10

[52] U.S. Cl. ..... 165/104.18; 165/104.16; 55/222; 55/267; 261/152; 261/157

[58] Field of Search ..... 165/104.18, 104.16, 165/104.15; 55/222, 267; 261/152, 157

[56] References Cited

U.S. PATENT DOCUMENTS 4,361,182 11/1982 Michalab ..... 165/104.18

*Primary Examiner*—Albert W. Davis, Jr.
*Attorney, Agent, or Firm*—Becker & Becker, Inc.

[57] ABSTRACT

A regenerative gas-gas heat exchanger having a column type of construction, and heat transferring elements which absorb heat in a hot gas flow, give off heat in a cold gas flow, and are cyclically conveyed from one of the gas flows to the other. The heat transferring elements form a fluidized bed during the operation; this fluidized bed, in relation to the gases which flow in an upward direction through the gas permeable column bottom, moves in a counter-cross flow over this column bottom.

5 Claims, 3 Drawing Figures

COLUMN-TYPE REGENERATIVE GAS-GAS HEAT EXCHANGER WITH HEAT-TRANSFERRING ELEMENTS

This a divisional application of co-pending parent application U.S. Ser. No. 421,485—Michalak et al filed Sept. 22, 1982, now U.S. Pat. No. 4,598,766—Michalak et al dated July 8, 1986.

FIELD OF THE INVENTION

The present invention relates to a regenerative gas-gas heat exchanger having a column type of construction, and heat-transferring elements circulating between hot gas and cold gas. In particular, the elements absorb heat in a hot gas flow, give off heat in a cold gas flow, and are cyclically conveyed from one of said gas flows to the other.

DESCRIPTION OF THE PRIOR ART

Different constructions of regenerative gas-gas heat exchangers are known. Along with rotary heat exchangers which have a rotating heat-retaining mass or rotating gas passages, numerous embodiments with bulk or fill layers or fluidized beds are also known, according to which the heat is transferred from a hot gas onto a solid-body particle, and is then transferred from this particle to the cold gas which is to be heated. Basically, two different groups of this known type of heat exchangers exist. In the first group, fine-grained particles with sand, glass balls, or the like are used as heat-transferring solid-body particles. These compact particles, which are generally less than 1 mm in size, though in certain instances are as large as 5 or 10 mm, are generally supplied to the gas in counter-flow, or have gas flowing therethrough in fluidized beds. The solid matter particles are simultaneously transported or carried, in certain situations along with a temporary storage, from the hot gas side to the cold gas side and back. See for instance British Pat. No. 1500231; French Pat. No. 2452689; German Offenlegungsschrift No. 2807110; British Pat. No. 2010463A; and British Pat. No. 1375238.

In the second group, relatively large and heavy particles, such as stones, metal balls, or the like are used as heat-transferring elements. These elements form bulk or fill layers, having the gases flowing therethrough, in the parts of the column or in the individual chambers of the heat exchanger. The elements are likewise cyclically transported or conveyed from one gas side to the other gas side (see for instance German Offenlegungsschrift No. 1601178).

In certain applications, the known systems are connected with such great disadvantages that they cannot be utilized. This is true for instance for the regenerative reheating of wet-cleaned flue gases. Exhaust or waste gases containing noxious materials from combustion plants or from other industrial systems are increasingly supplied to flue gas scrubbers. The gases discharge moisture-saturated from these scrubbers. Before introduction into the atmosphere, these gases must in many situations be heated up. It would be technically and economically expedient to be able to take the energy necessary for such heating-up from the hot exhaust or waste gas before entry of the latter into the scrubber. This, however, is difficult with the known heat exchangers. On the one hand, the unpurified, untreated gas carries along dust particles; during cooling-off of this gas in the heat exchanger, temperatures can fall below the acid dew point; droplets and residue of the absorbent used in the scrubber are carried along in the purified or cleaned gas. The interaction of these solid and liquid components which are carried along by the gas leads to deposits and incrustations in the heat exchanger. The already technically complex and correspondingly expensive rotary heat exchangers additionally require what, at least in part, are quite complicated cleaning devices. The danger exists with the aforementioned heat exchangers having fine-grained material that the particles become incrusted and stick together, and that the heat exchanger eventually fails. High pressure losses arise with the heat exchangers which utilize large particles in the bulk or fill layer; with large gas volumes, for example in coal-fired power plants with up to $2\times10^6$ cubic meters per hour ($m^3/h$), the uniform gas distribution onto the large surface engaged by the gas flow also causes difficulties.

It is therefore an object of the present invention to produce a regenerative gas-gas heat exchanger which renders possible an intensive heat exchange between a hot gas flow and a cold gas flow without the indicated disadvantages of the known heat exchangers being encountered.

This object, and other objects and advantages of the present invention, will appear more clearly from the following specification in connection with the accompanying drawings, in which.

The heat exchanger of the present invention is characterized primarily in that the heat exchanger comprises two separate column parts having gas-permeable plates or bottoms, with one of the parts being accommodated in the hot gas flow, and the other part being accommodated in the cold gas flow. The gas flows through the column parts from the bottom toward the top. Heat transferring elements are located above the bottom in a fluidized bed. The elements move in a counter-cross flow relative to the gas, and are cyclically conveyed via a sluice or charging-valve transporting system from one column part to the other column part. An essential feature according to the teaching of the present invention is the proper selection of the heat transferring elements. On the one hand, the heat transferring elements must be light enough that they form a whirl layer of the fluidized bed above the gas permeable plates or column bottom; on the other hand, the heat transferring elements must be heavy enough so that the energy during collision and during friction is sufficient for a continuous self-cleaning of the heat transferring elements during operation.

Figure 1:
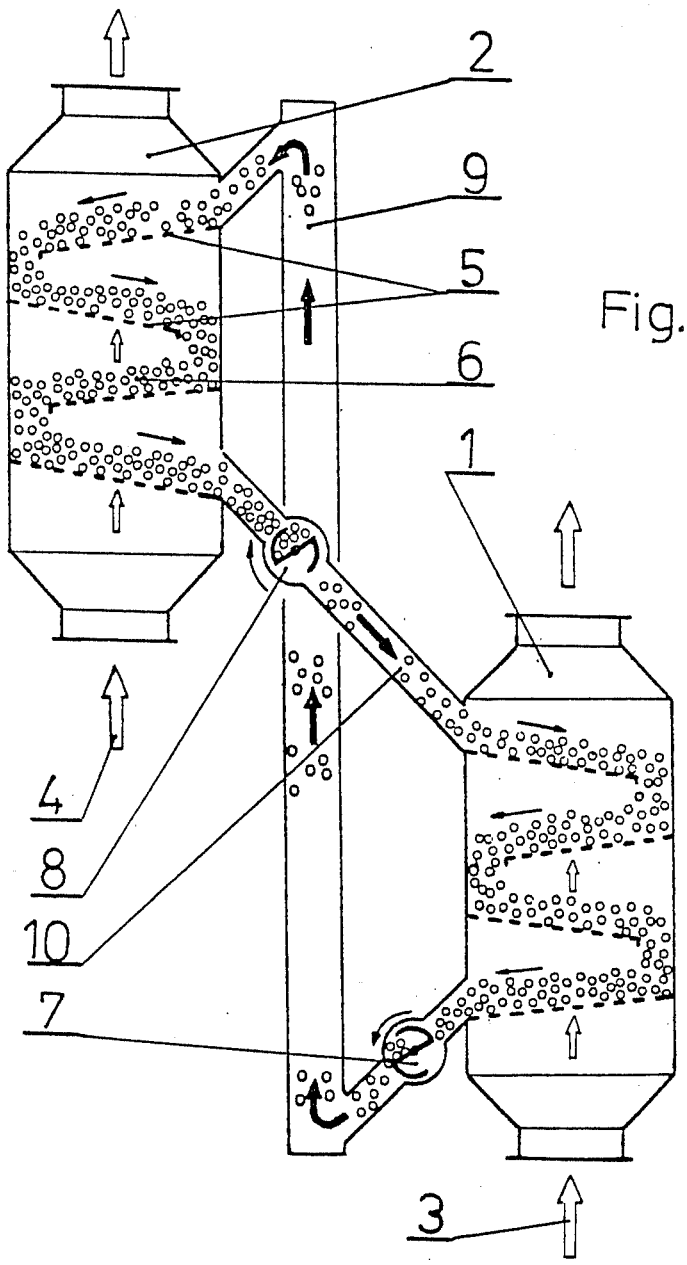
FIG. 1 is a schematic elevational view of one embodiment of a column heat exchanger having features in accordance with the present invention.

Referring now to the drawings in detail, FIG. 1 shows a column heat exchanger having a part 1 through which hot gas 3 flows, and a part 2 through which cold gas 4 flows. The heat-transferring elements 6 are located in a fluidized bed above the gas permeable column plate or bottom 5. The heat-transferring elements 6 move in a counter-cross current relative to the gas, leave the column parts 1 and 2 via sluice or charging-valve systems 7 and 8, and are conveyed from one column part to the other column part via transporting channels 9 and 10.

Figure 2:
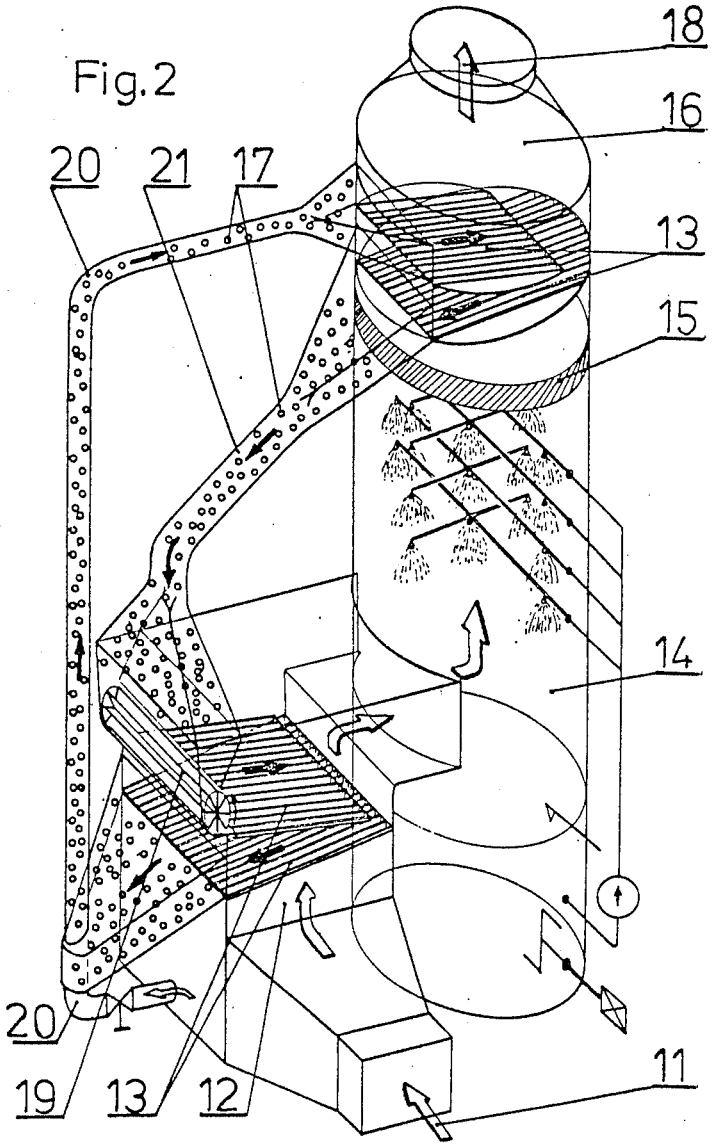
FIG. 2 is a perspective view diagrammatically showing the application of another embodiment of a column heat exchanger in accordance with the present invention.
Figure 3:
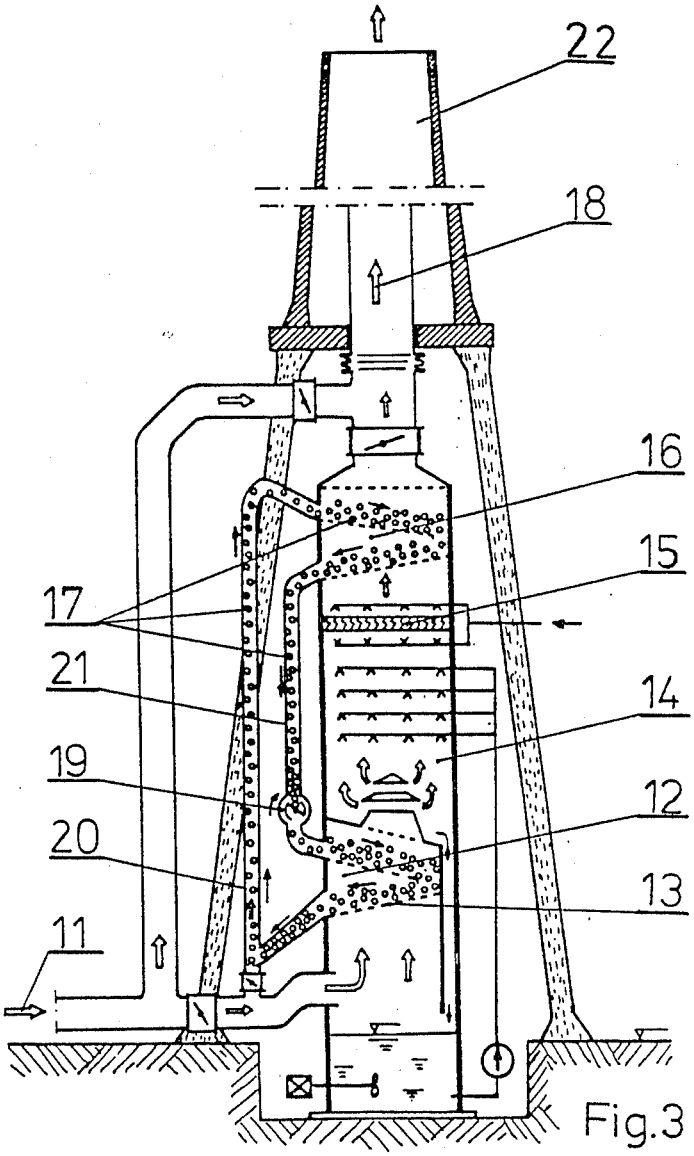
FIG. 3 is a partially sectioned schematic elevational view showing the application of yet another embodiment of a column heat exchanger having features in accordance with the present invention.

FIGS. 2 and 3 show the application or utilization of a column heat exchanger according to the present invention for reheating wet-cleaned or purified flue gases. The hot untreated gas 11 enters the washer or scrubber 14 via the column part 12 having the plate or bottom 13. The untreated gas 11 flows through the scrubber from the bottom toward the top, and, following the drop filter or separator 15, reaches the column part 16 in which the now treated gas 11 absorbs the heat from the elements 17 and is conveyed as reheated purified or cleaned gas 18 to the chimney or flue 22 (FIG. 3). While the elements 17 are fed or supplied from the column part 16 by gravity through a channel 21 to the sluice or charging valve 19 and to the column part 12, these elements are conveyed in the reverse direction, i.e. from the column part 12 to the column part 16, pneumatically through the line 20 by a partial flow of the untreated gas.

FIGS. 2 and 3 also show how the reheating can be integrated entirely or partially in a gas scrubber in an advantageous manner.

Preferred embodiments or constructions of the elements include balls, spheres, or hollow spheres with a diameter of 20 mm to 100 mm, as well as saddle-shaped bodies of the same size. The weight of the individual elements, depending upon size and gas speed, is preferably 2 to 30 g. For particular applications, such as the reheating of purified or cleaned flue gases of power plants, because of the relatively low temperature level of approximately 40° C. to 150° C., elements made of synthetic material having an extraordinarily high corrosion resistance are especially suitable. To increase the thermal conductivity and/or the heat-retaining capacity, further material may be added to the synthetic material. Reference can be made to co-pending U.S. patent application Ser.No. 421,488—Michalak et al filed Sept. 23, 1982 based on German application No. P 32 13 972.1 filed concurrently herewith, now U.S. Pat. No. 4,509,584—Michalak et al issued Apr. 9, 1985 and belonging to the assignee of the present application for details concerning the heat-transferring elements.

The inventive heat exchanger may be used for reheating gases after a wet washing or scrubbing of exhaust gas.

The heat exchanger columns may be integrated in the scrubber head and/or in the lower part of the scrubber for heating up the purified or cleaned gas and/or for absorbing heat from the untreated gas.

The reheated cleaned gas may be conveyed directly from the column part, which serves for reheating, into the chimney or flue located thereabove.

The present invention is, of course, in no way restricted to the specific disclosure of the specification and drawings, but also encompasses any modifications within the scope of the appended claims.

What we claim is:

1. A column-type regenerative gas-gas heat exchanger which usable for reheating gases after a wet washing or scrubbing of exhaust gas via a scrubber and which is provided with heat-transferring elements which absorb heat from hot gas, and give off heat to cold gas, said heat exchanger in combination comprising:

a first column part;

a second column part, each of said column parts being integrated in the scrubber for heating up purified cleaned gas as well as for absorbing heat from untreated gas and being provided with at least one gas-permeable plate; said second column part being located above said first column part when viewed in the direction of gas flow, which flows in an upward direction through said gas-permeable plates of said column parts; said heat-transferring elements forming a fluidized bed in said first and second column parts during operation, and being cyclically conveyed from said second column part to said first column part; said fluidized bed moving counter-cross current to said gas flow an over said gas-permeable plates of said column parts; and at least one sluice/charging valve means arranged operatively with said first and second column parts to control and regulate time of engagement of hot gas relative to said first and second column parts via adjustment of speed of rotation of said valve means.

2. A heat exchanger in combination to claim 1, in which said heat-transferring elements have a weight of 2–30 g, a size of 20–100 mm, and are selected from the group consisting of spheres, hollow spheres, and saddle-shaped bodies.

3. A heat exchanger in combination according to claim 2, in which said heat-transferring elements are made of synthetic material.

4. A heat exchanger in combination according to claim 3, in which said synthetic material includes an additive for the purpose of increasing the thermal conductivity thereof.

5. A heat exchanger in combination according to claim 3, in which said synthetic material includes an additive for the purpose of increasing heat-retaining capacity thereof.

* * * * *